US005341523A

United States Patent [19]

Barnes

[11] Patent Number: 5,341,523

[45] Date of Patent: Aug. 30, 1994

[54] ANTI-VORTEX DRAIN

[75] Inventor: Steven R. Barnes, Phoenix, Ariz.

[73] Assignee: Caretaker Systems, Inc., Scottsdale, Ariz.

[21] Appl. No.: 30,903

[22] Filed: Mar. 15, 1993

[51] Int. Cl.[5] ..... E04H 4/00

[52] U.S. Cl. ..... 4/507; 4/689; 4/287; 4/292; 285/42; 137/362; 210/163; 210/166

[58] Field of Search ..... 4/490, 507, 688, 689, 4/690, 508, 509; 52/169.14, 126.4, 12, 14, 15; 285/42; 137/363, 590; 405/40, 41, 39; 210/163, 164, 165, 166, 459, 460, 462

[56] References Cited

U.S. PATENT DOCUMENTS

| | | | |
|---|---|---|---|
| 149,373 | 4/1874 | Clapp . | |
| 597,482 | 1/1898 | Russell | 4/287 |
| 868,130 | 10/1907 | Russell | 137/381 |
| 1,427,809 | 9/1922 | Hartline | 4/267 |
| 1,505,026 | 8/1924 | Holmgreen | 137/371 |
| 1,584,453 | 5/1926 | Hess | 210/163 |
| 1,720,149 | 7/1929 | Rom | 4/287 |
| 1,792,345 | 2/1931 | Williams | 285/42 |
| 2,003,770 | 6/1935 | Goodhart | 210/163 |
| 2,695,073 | 11/1954 | Sisk | 182/31 |
| 2,695,678 | 11/1954 | Sisk | 182/31 |
| 2,777,532 | 1/1957 | Sisk | 182/31 |
| 3,378,858 | 4/1968 | Jacuzzi | 4/507 |
| 3,561,470 | 2/1971 | Hawle | 137/371 |
| 3,703,302 | 11/1972 | Demler, Sr. | 285/42 |
| 4,276,163 | 6/1981 | Gordon | 210/136 |
| 4,460,462 | 7/1984 | Arneson | 210/163 |
| 4,487,219 | 12/1984 | Mäkelä et al. | 4/292 |
| 4,492,491 | 1/1985 | Lunden | 405/119 |
| 4,658,449 | 4/1987 | Martin | 4/496 |
| 4,876,749 | 10/1989 | Antoniello | 4/689 |
| 4,956,948 | 9/1990 | Hart | 52/16 |

*Primary Examiner*—Henry J. Recla
*Assistant Examiner*—Gregory Vidovich
*Attorney, Agent, or Firm*—LaValle D. Ptak

[57] ABSTRACT

An anti-vortex, flush-mounted floor drain for swimming pools consists of a main housing, which is in the form of a hollow cylinder of a first predetermined diameter. A drain opening is located in the top of the hollow cylinder; and the edges of the top of the cylinder are mounted flush with the floor of the swimming pool. A downwardly sloped lip extends from the top edge of the main housing and terminates in a circular opening in the top of the main housing. A solid circular cover is centrally mounted in this opening in the main housing, and is movable toward and away from the opening in the main housing to vary the size of the water inlet from the pool between the edge of the circular cover and the edge of the opening in the main housing. A drain pipe is connected to the main housing for withdrawing water from the housing. The large circular cover at the center of the drain prevents a vortex from occuring as a result of the suction of water passing outwardly through the drain pipe in the drain housing.

12 Claims, 2 Drawing Sheets

FIG. 5
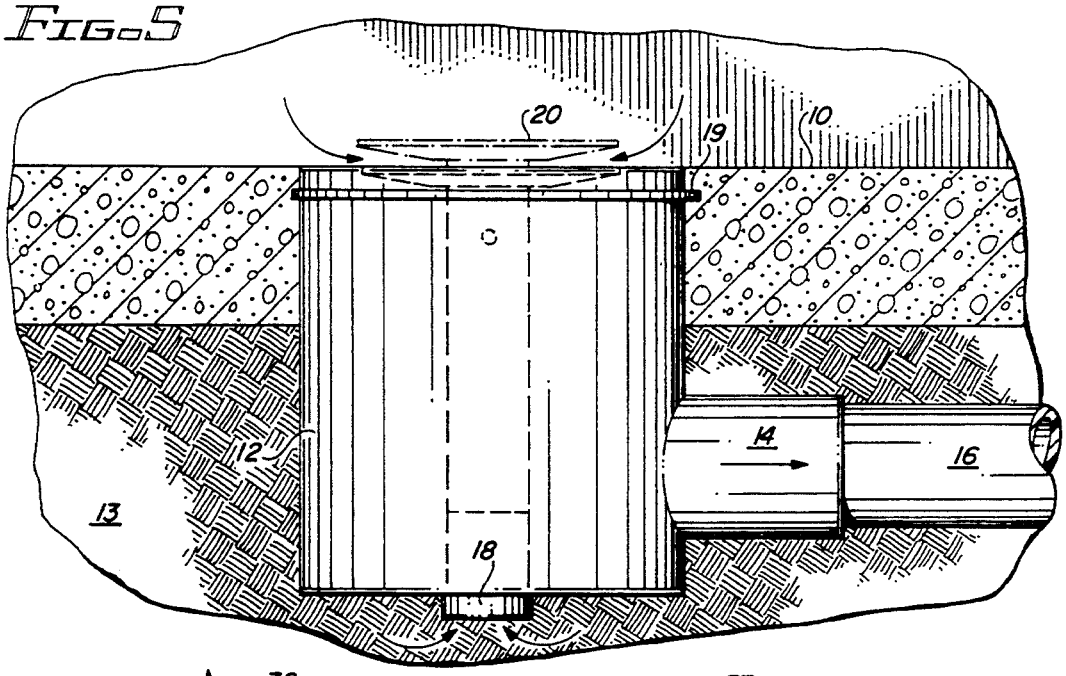
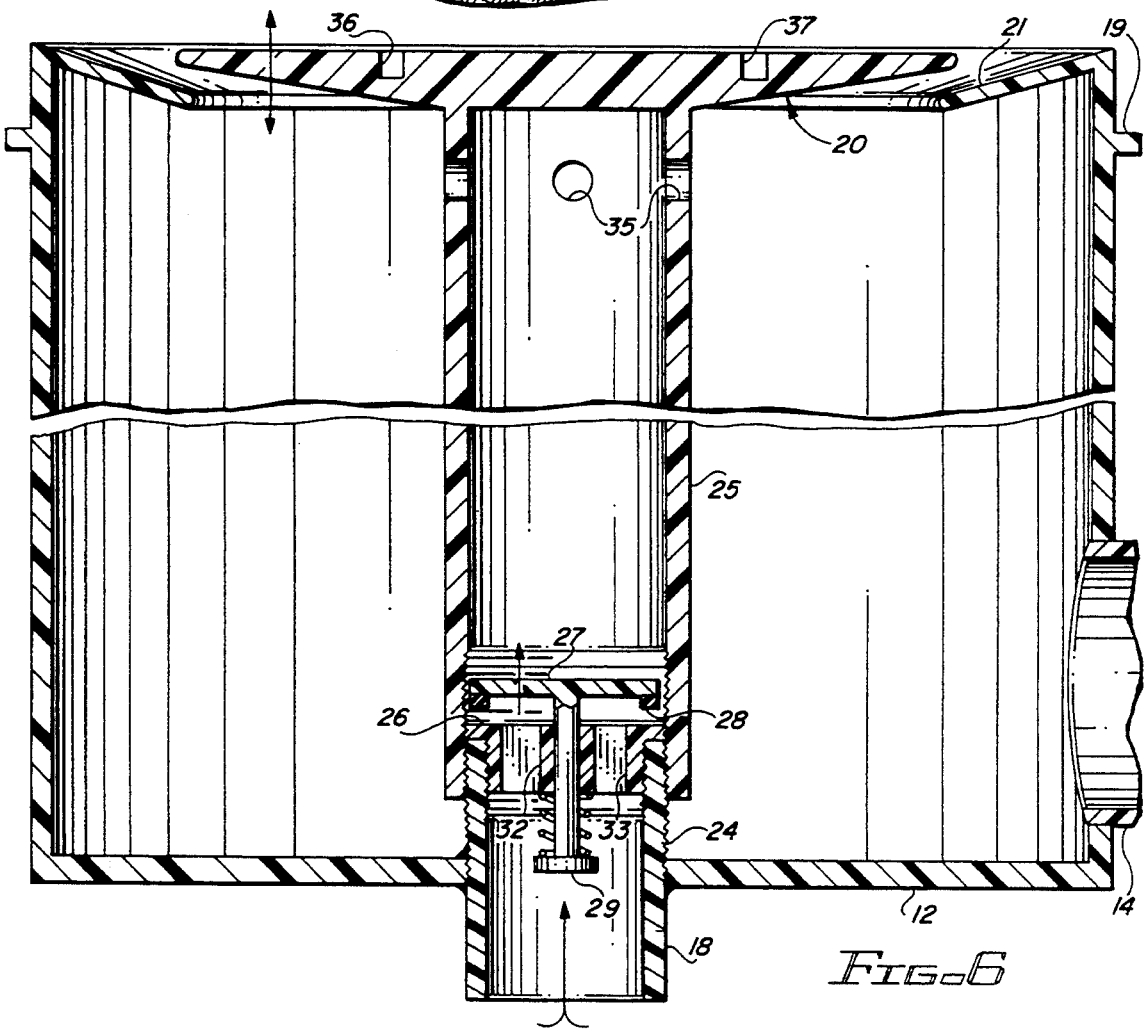
FIG. 6

ANTI-VORTEX DRAIN

BACKGROUND

The typical drain in the bottom of a swimming pool is a flushmounted grate, with relatively small rectangular or circular openings in the grate. The grate covers a circular drain opening, which extends through the floor of the swimming pool and is attached to a drain pipe (typically of 2" to 4" in diameter). The drain pipe is connected with the recirculating pump of the pool, which removes water through the drain of the pool, to supply that water through a filtration system and, ultimately, back to return lines for the pool. A relatively large volume of water is moved through the drain while the pump is operating. The grate placed in the opening of the drain is designed to prevent leaves and other debris from passing through the main drain, since such leaves can clog the leaf catching basket, which usually is placed between the intake of the pump and the drain.

In addition, conventional swimming pool drains can produce a whirlpool vortex as a result of the suction of water passing outwardly through the drain pipe at the bottom of the drain pot or drain housing. It is possible for such a vortex to have sufficient force that the hair or other body portions of a swimmer, can be sucked downwardly by the vortex and be trapped by the suction of the drain. This is a significant safety problem with the past designs of some swimming pool drain systems.

Swimming pool drains, which have been used in the past, also are not adjustable to regulate the size of the openings in the cover or to regulate the amount of water flow which may take place through the drain. Once such drains are in place, they remain fixed. The size of the openings and the water flow rate are determined in advance of the construction of the pool into which the drain is placed.

A drain designed to facilitate the flow of water through the drain cover and into a drain pot is disclosed in three patents to Sisk U.S. Pat. Nos. 2,695,073; 2,695,678; and 2,777,532. The drain pot disclosed in these patents is constructed with a support rim around it for holding the drain cover. The support rim has a number of arcuate slots in it to facilitate the flow of water through the slots down the sides of the drain. The cover then fits over the large drain opening, and is in the form of a generally standard slotted grate. There is no provision in any of the Sisk patents for adjusting the size of the slots or the size of the opening between the cover and the lip of the drain pot.

The patent to Clapp No. U.S. Pat. No. 149,373 discloses a drain cover or grating which is similar in constructional aspects to the ones disclosed in the Sisk patents. The drain system of Clapp, however, has a cover which is concave in shape, and protrudes above the surface of the area surrounding the drain pot.

The patent to Lunden U.S. Pat. No. 4,492,491 is directed to a drain or roof outlet for rainwater. The cover of the outlet or drain of Lunden fits in the center of the drain; so that the water flow enters into the drain around the edges of the cover between the edges and the edge of the drain pot. The cover itself, however, is made of screen material; so that water also can flow through the cover, as well as around the edges of the cover.

It is desirable to provide an anti-vortex drain, particularly suited for a flush-mounted swimming pool drain, which is of simple construction and easy to install.

SUMMARY OF THE INVENTION

Accordingly, it is an object of this invention to provide an improved drain for pools.

It is another object of this invention to provide an improved anti-vortex drain for pools.

It is an additional object of this invention to provide an improved adjustable anti-vortex drain for pools.

It is a further object of this invention to provide an improved anti-vortex drain for swimming pools, in which the size of the drain opening can be varied.

In accordance with a preferred embodiment of the invention a drain for pools includes a main housing, with a top and bottom, and having a circular opening in the top of the housing. The main housing is adapted to be mounted flush with the surface or floor of a pool, such as a swimming pool or the like. A solid circular cover member is mounted in the circular opening of the main housing to cause water flow from the pool into the housing to take place between the edge of the cover member and the edge of the circular opening in the top of the housing. Water flowing into the main housing is removed from the main housing through a drain pipe.

BRIEF DESCRIPTION OF THE DRAWINGS

FIG. 5 is a side view of the embodiment shown in FIG. 1, indicating the position of installation in a pool; and FIG. 6 is a cross-sectional view of the embodiment shown in FIG. 5.

DETAILED DESCRIPTION

Figure 1:
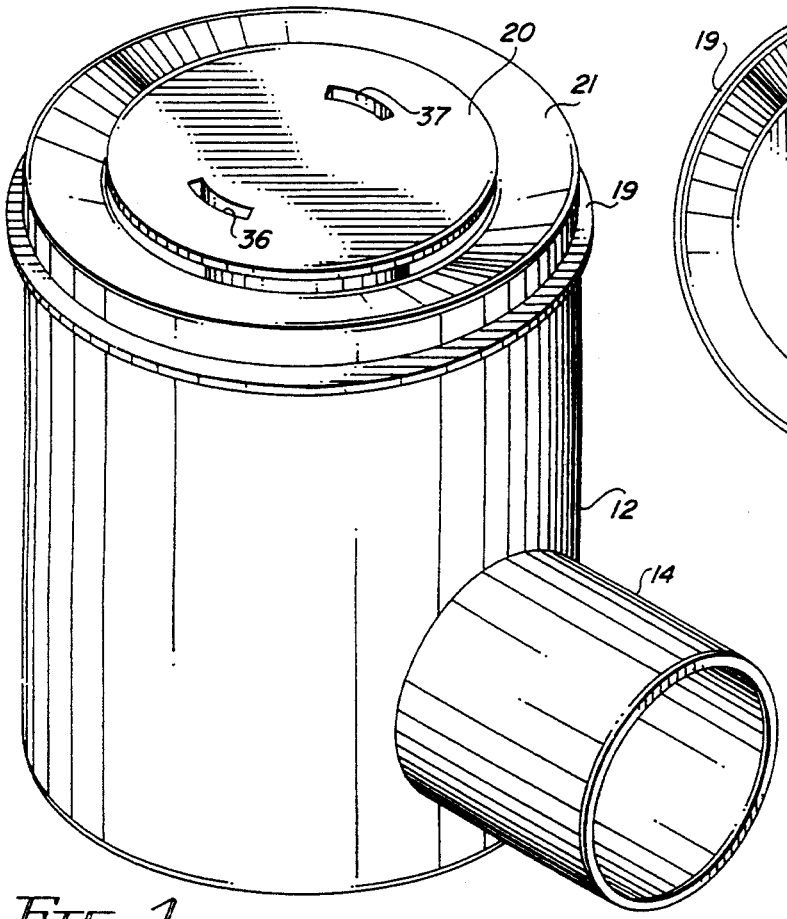
FIG. 1 is a perspective view of a preferred embodiment of the invention.
Figure 3:
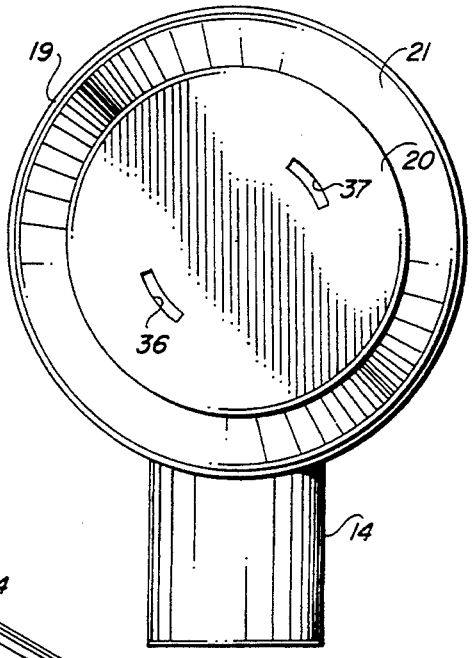
FIG. 3 is a top view of the embodiment of invention shown in FIG. 1.
Figure 2:
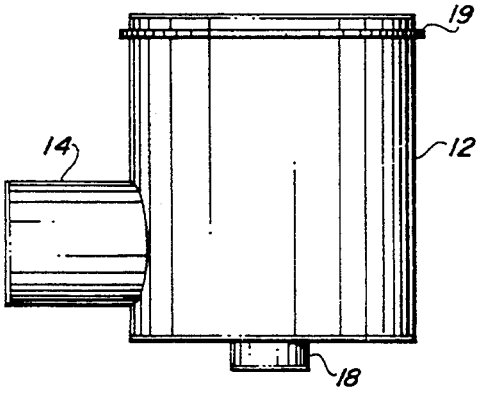
FIG. 2 is a side view of the embodiment shown in FIG. 1.
Figure 4:
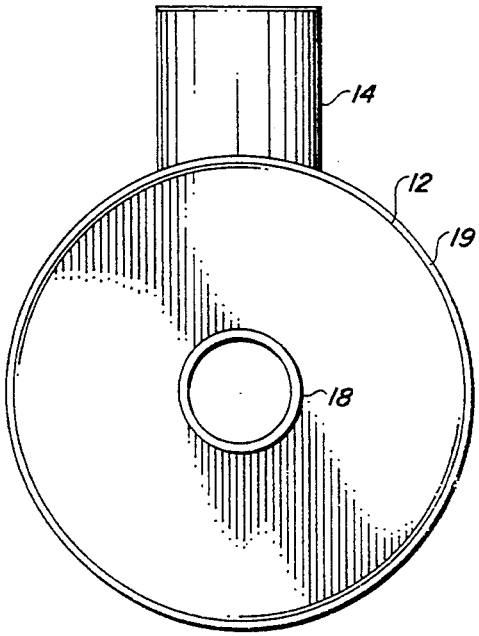
FIG. 4 is a bottom view of the embodiment shown in FIG. 1.

Reference now should be made to the drawings, in which the same reference numbers are used throughout the different figures to designate the same components. As shown in the drawings, an anti-vortex drain system, particularly suited for use as a floor drain for swimming pools, is illustrated. The external features of the drain are shown in FIGS. 1 through 4; and FIG. 5 illustrates the manner in which the drain itself is mounted in the floor 10 of a typical swimming pool. Many swimming pools are formed with a concrete floor 10 and walls made of gunite concrete formed in an excavation in the ground 13. The drain includes a main drain housing or drain pot 12, which has a relatively large external diameter (typically, nine or ten inches). A drain outlet 14 is provided in the housing, either through the side, as shown, or, for some installations, the outlet 14 may be placed in the bottom of the housing 12. As shown in FIG. 5, the outlet 14 typically is connected to a drain pipe 16, which in turn is connected to the water recirculation system for the pool. The outlet 14 is located in the ground 13 beneath the concrete 10 of the pool floor.

The upper end of the housing 12 includes a ledge 19 extending outwardly from the outer circumference of the housing 12 a short distance beneath the plane of its top surface. This ledge 19 functions to lock the drain housing 12 into the concrete 10 of the pool, as shown most clearly in FIG. 5. At the bottom of the housing 12, a short open pipe 18 is secured through a circular opening in the center of the housing 12, as illustrated most clearly in FIGS. 4 and 6. This short pipe 18 is secured in a watertight fashion in this hole, and it is externally and internally threaded, as illustrated in FIG. 6.

The opening in the top of the drain housing 12 is provided by an inwardly-sloped shoulder or lip 21, which extends a short distance from the outer edge of the housing 12 to form a relatively large circular opening in the center of the top of the drain housing 12. The shoulder 21 slopes downwardly, as shown most clearly in FIG. 6, to place the opening in the top of the housing below the plane of the upper edge of the drain housing 12. This upper edge is the one which is flush with the surface 10 of the pool floor.

A circular cover 20, which is flat on its upper surface and slightly tapered on its lower surface (shown most clearly in FIG. 6) is centrally mounted in the opening formed by the lip 21. The cover 20 has an outside diameter which is equal to or slightly larger than the diameter of the opening in the center of the shoulder 21; so that water, which flows into the housing 12 from the pool, passes between the lower edge of the cover 20 and the edge of the sloping shoulder 21, as shown in the arrows at the top of FIG. 5.

It is to be noted that there is nothing in the drain structure which is shown in FIGS. 1 through 6 to prevent the passage of leaves and other debris into the drain. In fact, a relatively large gap exists to permit leaves and such other debris to pass into the main drain housing, and then from that housing through the outlet 14 and the pipe 16. Such debris may be deposited into a debris trap located at a position which is readily accessible for the subsequent removal of the leaves.

By using a large circular flat top, located over a circular opening of approximately 6" width in the top of the drain, whirlpool vortexes are prevented from occurring as a result of the suction of water passing outwardly through the drain opening 14. The water, instead, flows in an even pattern around the entire circular edge of the lid 20 into the drain housing 12.

To permit adjustability of the vertical position of the top 20 relative to the circular opening formed by the shoulder 21, the lid 20 is supported by a hollow cylindrical support pipe 25 (which may be integrally formed with the lid 20) threaded onto the external threads 24 of the portion of the pipe 18 extending into the interior of the housing 12, as shown in FIG. 6. By rotating the top 20 in a clockwise direction, the top moves downwardly into the opening provided by the shoulder 21 to restrict the distance between the upper edge of the top 20 and the inner edge of the shoulder 21 forming the circular opening in the top of the drain housing. Conversely, when the top 20 is rotated in a counter clockwise direction, it raises upwardly, as shown by the arrows in FIG. 6, to increase the space between it and the opening in the top of the housing 12. This is indicated in the dotted lines of FIG. 5, which illustrate movement of the top 20 to a position above the plane of the upper edge of the housing 12. In this uppermost position, a maximum opening for maximum water flow, along with relatively large-size debris, can take place into the housing 12 and from there through the outlet 14, as described above.

The central pipe 25 also has several holes 35 located in it to communicate with the internal volume of the main housing 12. These holes are used in cooperation with a hydrostatic pressure relief valve 27 mounted in a plug 26 secured to the inside of the pipe 18, as shown in FIG. 6. The valve 27 is spring loaded to a closed position where a resilient O ring or seal 28 is pressed by the spring of the pressure relief valve 29 to close passageways 32 and 33 in the pressure relief valve to prevent fluid from passing outwardly through the pipe 18 (and, conversely, from passing in the opposite direction into the pipe 18).

Hydrostatic pressure relief valves are commonly used in the main drain housings or drain pots of swimming pools to prevent groundwater from floating the pool when the pool is drained or insufficient water is maintained within the pool to prevent such floating. Whenever the pressure of the groundwater beneath the drain pot 12 exceeds the pressure of the water in the pool above the drain, the valve member 27 is moved to the solid line position shown in FIG. 6. This then permits water flow to take place upwardly through the apertures 32 and 33 and around the edges of the member 27 carrying the O ring 28, and, subsequently, out through the holes 35 and from the drain housing 12 between the cover 20 and the edge of the shoulder 21 into the pool. This then provides the pressure relief necessary to prevent damage to the pool in the event of hydrostatic pressure formation beneath the pool.

The utilization of the central support pipe 25, functioning in conjunction with the hydrostatic relief pipe 18, results in a compact, simple construction for incorporating the hydrostatic relief operation with the adjustable positioning of the cover 20.

To facilitate the rotational operation described above for adjusting the vertical height of the cover 20, with respect to the opening in the top of the housing 12, a pair of indentations of slots 36 and 37 are formed on opposite sides of the center axis of the cover 20. These slots extend partially through the thickness of the cover 12, and are located to permit a correspondingly-shaped tool (not shown) to be inserted into them. The tool, in turn, is connected to a long handle (not shown); so that rotation of the cover 12 in either direction may be effected from a position above the surface of the water in the pool. In this manner, adjustment of the drain opening size may be accomplished at any time, without requiring the person making such an adjustment to dive into the pool and effect it from the pool bottom where the pool drain apparatus is located.

The foregoing description of the preferred embodiment of the invention is to be considered as illustrative, and not as restrictive. For example, the manner of effecting the vertical adjustment of the cover 20, with respect to the opening in the top of the housing 12, may be effected by means other than the threaded rotational mechanism illustrated. In addition, the hydrostatic valve may be eliminated; or it may be located in a position which is independent of the support for the cover member 20. As mentioned previously, the outlet 14 for the housing may be from the bottom or from both the side and bottom of the main housing 12, if desired. Various other changes and modifications will occur to those skilled in the art, without departing from the true scope of the invention as defined in the appended claims.

I claim:

1. An improved drain for a floor surface of a pool including in combination:

a main cylindrical housing with a first predetermined diameter, a top and a bottom and having a cylindrical side wall terminating in an upper peripheral edge, a top flange depending from said upper peripheral edge and extending radially inwardly and downwardly from said side wall to define a circular opening of a second predetermined diameter wherein said top flange has an upper surface surrounding said opening, the top of said housing further adapted for mounting said upper peripheral edge flush with the surface of the floor of a pool;

a solid circular cover member having a peripheral edge and a lower surface and mounted in, and spaced above, said opening such that said lower surface partially overlaps said upper surface;

means operatively connected between said cover and said housing for maintaining said cover and said upper surface in a spaced apart relationship thereby causing water flow from said pool into said housing to take place between the edge of said cover member and an edge of said opening; and means for removing water from said main housing.

2. The combination according to claim 1 wherein the diameter of said cover member and said second predetermined diameter of the opening in said main housing are substantially the same.

3. The combination according to claim 2 wherein said cover member is movable relative to the opening in said main housing in a direction parallel to an axis perpendicular to the center of the lower surface of said cover member.

4. The combination according to claim 3 further including support means for said cover member attached to the bottom of said main housing for moving said cover member toward and away from the opening in said main housing.

5. The combination according to claim 4 wherein said support means comprises a first cylindrical threaded extension attached to the bottom of said main housing, said extension having a central axis aligned with the center of said cover member, and said cover member has a second cylindrical threaded extension fixedly attached thereto and threadedly engaged with said first extension for telescoping movement therewith within said main housing.

6. The combination according to claim 5 wherein rotating said cover member in one direction moves said cover member toward the opening in said main housing and rotating said cover member in an opposite direction moves said cover member away from the opening in said main housing.

7. The combination according to claim 6 further including a hydrostatic pressure relief valve in the bottom of said main housing with an inlet for said hydrostatic pressure relief valve extending through the bottom of said housing.

8. The combination according to claim 7 wherein said hydrostatic pressure relief valve means is located in said first extension attached to the bottom of said main housing member, and further including apertures in said second extension for facilitating water flow between said hydrostatic valve means and said main housing.

9. The combination according to claim 1 wherein said cover member is movable relative to the opening in said main housing in a direction parallel an axis perpendicular to the center of the lower surface of said cover member.

10. The combination according to claim 1 further including a hydrostatic pressure relief valve in the bottom of said main housing with an inlet for said hydrostatic pressure relief valve extending through the bottom of said housing.

11. The combination according to claim 1 further including a hydrostatic pressure relief valve in the bottom of said main housing with an inlet for said hydrostatic pressure relief valve extending through the bottom of said housing.

12. The combination according to claim 11 wherein said hydrostatic pressure relief valve means is located in said first extension attached to the bottom of said main housing member, and further including apertures in said second extension for facilitating water flow between said hydrostatic valve means and said main housing.

* * * * *